US005740592A

United States Patent [19]

Lau

[11] Patent Number: 5,740,592

[45] Date of Patent: Apr. 21, 1998

[54] COFFINS

[75] Inventor: Chung Keong Lau, Singapore, Singapore

[73] Assignee: Excel Machine Tools Ltd., Singapore, Singapore

[21] Appl. No.: 696,856

[22] PCT Filed: Nov. 7, 1995

[86] PCT No.: PCT/IB95/00972

§ 371 Date: Nov. 19, 1996

§ 102(e) Date: Nov. 19, 1996

[87] PCT Pub. No.: WO96/15754

PCT Pub. Date: May 30, 1996

[30] Foreign Application Priority Data

Nov. 22, 1994 [GB] United Kingdom ..... 9423535

[51] Int. Cl.[6] ..... A61G 17/013

[52] U.S. Cl. ..... 27/4; 27/19

[58] Field of Search ..... 27/4, 2, 5, 17, 27/14, 35, 20, 19; 229/939, 3.5 MF; 220/441, 443, 445

[56] References Cited

U.S. PATENT DOCUMENTS

| | | | |
|---|---|---|---|
| 2,954,913 | 10/1960 | Rossman | 220/441 |
| 4,166,569 | 9/1979 | Begnaud et al. | 220/441 X |
| 4,730,370 | 3/1988 | Elder | 27/4 |
| 4,882,821 | 11/1989 | Sims, Jr. | 27/2 X |
| 5,353,484 | 10/1994 | Woedl et al. | 27/4 |
| 5,454,141 | 10/1995 | Ozbun et al. | 27/4 |

FOREIGN PATENT DOCUMENTS

| | | |
|---|---|---|
| 9217159 | 3/1993 | Germany . |
| 8204186 | 12/1982 | WIPO . |

*Primary Examiner*—Kien T. Nguyen
*Attorney, Agent, or Firm*—Mark R. Wisner

[57] ABSTRACT

A coffin comprising an open receptacle assembly for receiving a corpse and a cover assembly for closing the receptacle assembly, in which coffin at least one of the receptacle assembly and the cover assembly is constructed from corrugated cardboard panels fixed to a skeletal frame structure. The corrugated cardboard panels are comprised of two or more layers of corrugated cardboard having a layer comprised of foil lining separating each layer of corrugated cardboard.

15 Claims, 4 Drawing Sheets

COFFINS

This invention relates to improvements in or relating to coffins and more particularly to lightweight coffins making limited use of timber materials.

Conventional coffins are constructed using a combination of timber materials. An all timber construction produces a heavy coffin which is difficult to carry and transport especially when combined with the weight of a corpse. Further, an all timber construction necessitates the use of a large volume of timber which is environmentally damaging. The construction time involved in producing an all timber coffin is considerable and timber itself is an expensive commodity.

A coffin should perform two basic functions. Firstly, a coffin should be able to hold and store a corpse for a limited period of time. Secondly, a coffin should be able to be sealed to prevent a corpse inside from being attacked by external environmental agents over a limited period of time.

The present invention seeks to provide a coffin which is lightweight and which requires significantly less timber than a conventional all timber coffin construction.

Accordingly, the present invention provides a coffin comprising an open receptacle assembly for receiving a corpse and a cover assembly, in which coffin at least one of the receptacle assembly and the cover assembly is constructed from corrugated panels fixed to a skeletal frame structure.

In order that the present invention may be more readily understood, embodiments thereof will now be described, by way of example, with reference to the accompanying drawings, in which.

Figure 1:
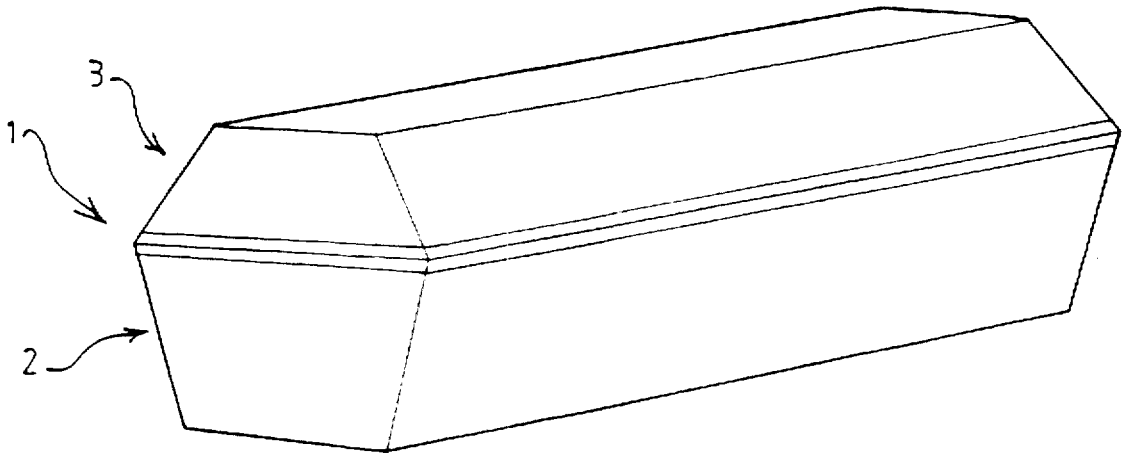
FIG. 1 is a perspective view showing a coffin embodying the present invention.

FIG. 1 shows one embodiment of a coffin according to the present invention. The coffin 1 comprises an open receptacle assembly 2 in which a corpse may be rested and a cover assembly 3 for attachment to the receptacle assembly 2 to act as a lid to close the receptacle assembly 2.

Figure 2:
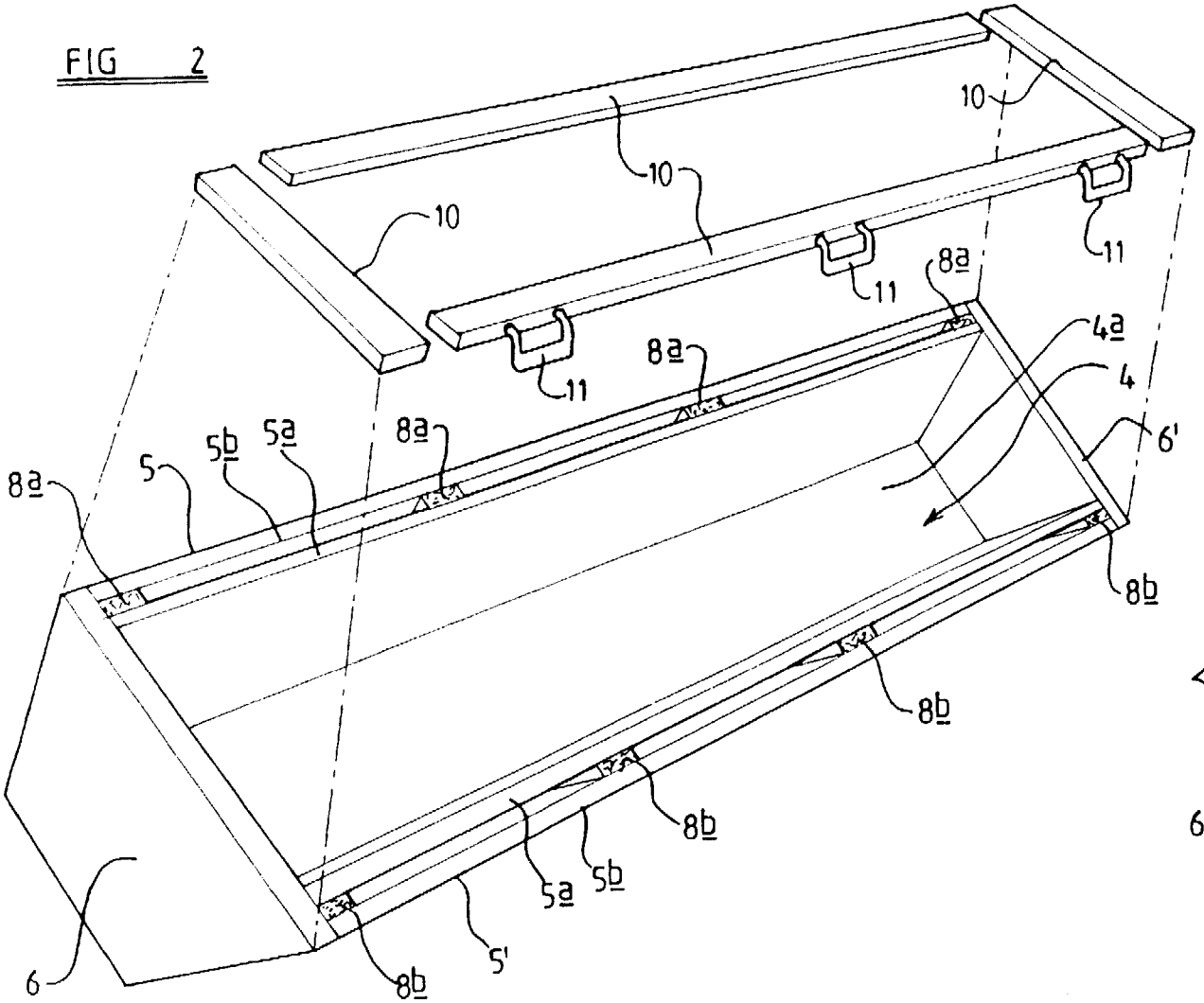
FIG. 2 is a perspective view of a lower cover assembly of the coffin of FIG. 1.

Referring to FIG. 2, the receptacle assembly 2 comprises a shallow elongate box having an elongate rectangular floor 4, two elongate side walls 5, 5' and two end walls 6, 6' extending upwardly from the transverse edges of the floor 4. In the embodiment shown in FIGS. 1 and 2, the side walls 5, 5' are rectangular and extend at an angle to the floor 4 to diverge upwardly from the floor 4. The end walls 6, 6' are trapezium-shaped and extend perpendicular to the floor.

The floor 4 comprises an inner floor panel **4*a* and an outer floor panel 4*b* (not shown) spaced apart from one another and each side wall 5, 5', comprises an inner side wall panel 5*a* and an outer side wall panel 5*b* spaced apart from one another. Each of the end walls 6, 6' comprises a single end panel 6. Each of the floor panels 4*a* and 4*b*, the side wall panels 5*a* and 5*b* and the end panel 6** is made of corrugated cardboard.

Figure 3:
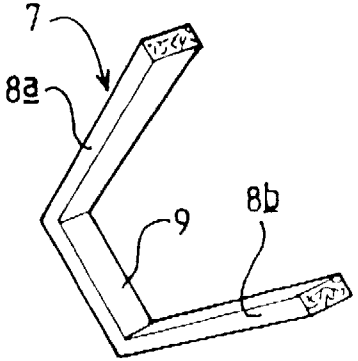
FIG. 3 is a perspective view of a wooden frame for use with the lower cover assembly shown in FIG. 2.

The inner panels **4*a*, 5*a* and the outer panels 4*b*, 5*b* of the floor 4 and of each side wall 5, 5' are fixed to and spaced apart by a plurality of substantially U-shaped wooden frames 7. Each U-shaped frame 7 comprises two divergent arms 8*a*, 8*b* extending from respective ends of a cross-member 9 as shown in FIG. 3. The arms 8*a*, 8*b* of each frame 7 separate the inner and outer panels 5*a*, 5*b* of the respective side walls 5, 5' and the cross-member 9 of the U-shaped frame 7 separates the inner panel 4*a* from the outer panel 4*b* of the floor 4**.

The receptacle assembly 2 shown in FIG. 2 has a skeletal frame structure comprising four such U-shaped wooden frames 7 equally spaced along the length of the receptacle assembly 2. One frame 7 is located immediately adjacent to one end of the receptacle assembly and another of the wooden frames 7 is located immediately adjacent to the other end of the receptacle assembly and the end walls 6, 6' are fixed to these endmost frames 7.

Preferably, the panels **4*a*, 4*b*, 5*a*, 5*b* and 6 are fixed to the wooden frames 7 using alloy screws or by a suitable adhesive or resin. Alternatively, the panels of the floor, side walls 5, and end walls 6**, may be stapled to the frames or fixed in some other manner.

Figure 4:
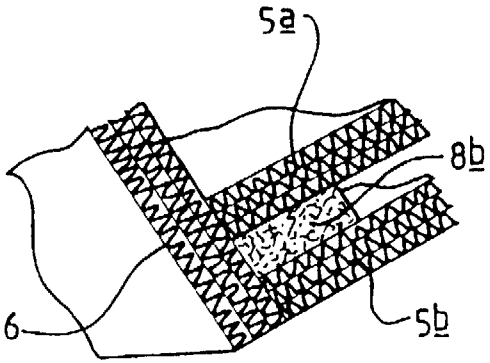
FIG. 4 is an enlarged perspective view of the construction of a corner of the lower cover assembly shown in FIG. 2.

Four sealing strips are fixed to the respective top edges of the side walls 5 and the end walls 6 of the receptacle assembly 2 to seal the spaces between the side wall panels **5*a* and 5*b* and to form a sturdy rim around the receptacle assembly 2. The sealing strips 10 comprise lengths of wood or a plastic material. Preferably, the sealing strips 10 are provided with handles 11 which project outwardly from the rim of the receptacle assembly 2 such that, when the sealing strips have been fixed to the receptacle assembly 2, the handles may be used for carrying the coffin FIG. 4 is a detailed view of the structure of a corner of the receptacle assembly 2 shown in FIG. 2 and illustrates the inner and outer panels 5*a*, 5*b* of the side wall 5 joined to a U-shaped wooden frame 7 as well as an end wall 6** joined to the same wooden frame.

Figures 5A, 5B, 5C:
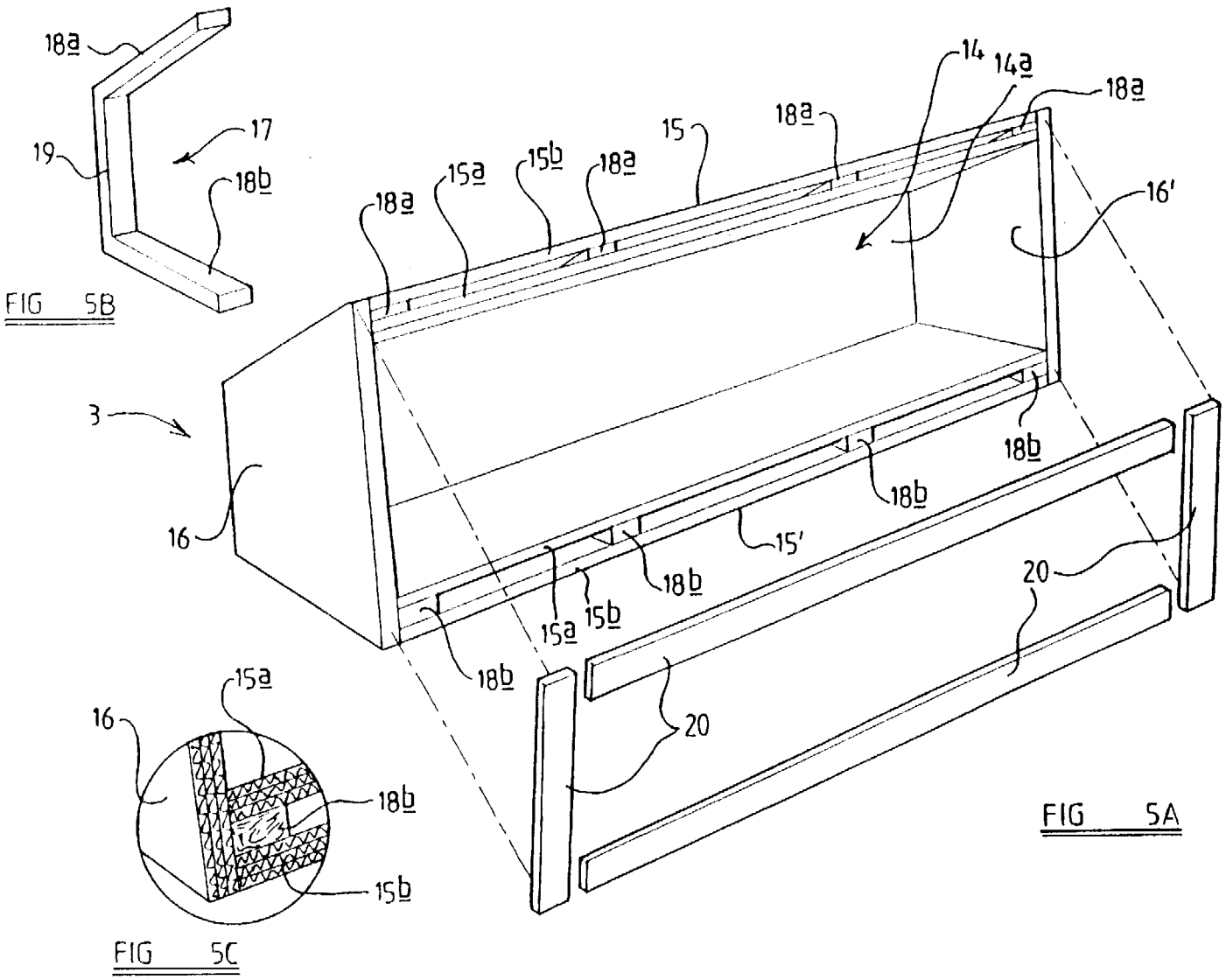
FIGS. 5A–5C are perspective views of an upper cover assembly of the coffin shown in FIG. 1.

The cover assembly 3 shown in FIG. 5 is constructed in a similar fashion to the receptacle assembly 2 shown in FIG. 2. However, in this case the divergent side walls 15, 15' extend downwardly from the longitudinal edges of a top wall 14. Inner and outer panels **15*a*, 15*b* of the side walls 15, 15' are joined, as previously discussed with reference to the side walls 5, 5' of the receptacle assembly 2, to arms 18*a*, 18*b* of U-shaped wooden frames 17. The top wall 14 comprises an inner panel 14*a* and an outer panel 14*b* which are spaced apart by the cross-members 19 of the U-shaped frames 17 in a similar manner to the floor panels 4*a*, 4 *b* of the receptacle assembly 2. The ends of the cover assembly 3 are closed by respective end walls 16, 16' in the form of single panels fixed to the endmost frames 17**.

A set of sealing strips 20 are fixed to the bottom edges of the side walls 15, 15' and the end walls 16, 16' of the cover assembly 3 to form a rigid rim on the cover assembly 3.

A layer of sealant (such as silicone) is applied to all the joints in the receptacle and cover assemblies 2, 3 to ensure final and through sealing of the coffin 1.

In use of the described coffin 1, the corpse is laid in the receptacle assembly 2, the cover assembly 3 is placed on the receptacle assembly 2 and the sealing strips 10, 20 are joined together to seal the cover assembly 3 (the lid) of the coffin to the receptacle assembly 2 (the base) of the coffin.

Figure 6:
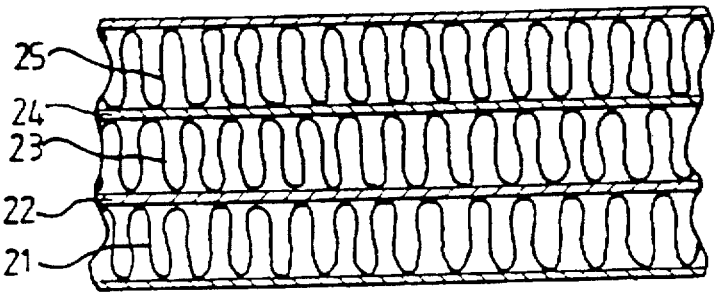
FIG. 6 is a cross-sectional view of a part of a panel of the coffin of FIG. 1.

In a preferred embodiment of the present invention, each panel of the floor 4 and the walls 5, 5', 6, 6' 14, 15, 15' 16 and 16' used in the coffin 1 is constructed using a three layer corrugated cardboard sandwich comprising a first layer 21 of corrugated cardboard, a first layer 22 of foil lining, such as aluminium foil, a second layer 23 of corrugated cardboard, a second layer 24 of foil lining and a third layer 25 of corrugated cardboard. This construction is shown in FIG. 6, the first foil layer 22 separating the first and second corrugated cardboard layers 21 and 23 and the second foil layer 24 separating the second and third corrugated cardboard layers 23 and 25.

The use of the illustrated sandwich construction provides high strength panels. The provision of the foil linings 22, 24 acts as a barrier to external environmental attack on a corpse within the coffin.

If the coffin 1 embodying the present invention is to be used for cremation purposes rather than for burial, then the foil linings 22, 24 may be omitted from the sandwich construction. Coffins 1 embodying the present invention are particularly suited for cremation due to the corrugated cardboard sandwich construction being readily combustible.

The major components of coffins embodying the present invention are manufactured from corrugated cardboard which is a light yet strong product. Only the skeletal frame structure consisting of the U-shaped frames 7 need be manufactured from stronger material such as timber.

The size of the coffin is, of course, determined by the size of the corpse to be accommodated in the coffin. However, FIG. 1 shows the dimensions of a typical coffin which is 2.2 meters in length, 60 centimeters in width and 50 centimeters in height.

The overall construction of coffins embodying the present invention is very lightweight compared to the all-timber construction of conventional coffins, a coffin embodying the invention being only about one third of the weight of a conventional all-timber coffin.

Coffins embodying the present invention are lower in cost due to the lower cost of the corrugated cardboard compared to timber materials and the simple method of construction.

The modular design of coffins embodying the present invention enables easy construction thereof and also allows the coffins to be transported in a flat-pack for subsequent assembly thus saving on transportation costs.

Figure 7:
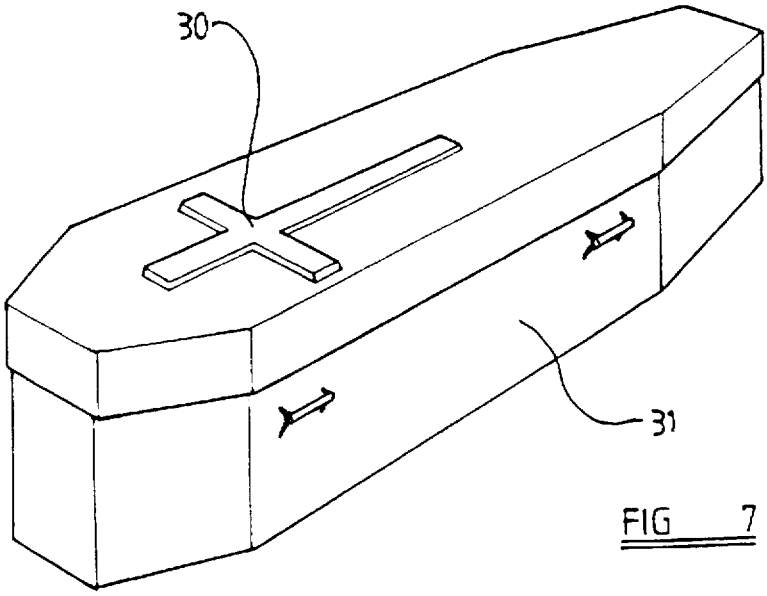
FIG. 7 is a perspective view of another coffin embodying the present invention.

Stick-on decoration 30, such as that shown in FIG. 7, may be applied to a coffin 31 which is of a different shape from the coffin 1 of FIG. 1 but is constructed from corrugated cardboard and wooden frames in accordance with the principles elucidated above with reference to FIGS. 1 to 6. The form of the decoration 30 may naturally be selected in dependence on the religious denomination of the corpse.

It is envisaged that either the receptacle assembly or the cover assembly may be replaced by a single panel or wall.

Although described in terms of the above-illustrated preferred embodiments, those skilled in the art who have the benefit of this disclosure will recognize that certain changes can be made in the manner in which the component parts thereof function to achieve their intended result. All such changes are intended to fall within the spirit and scope of the following claims.

I claim:

1. A coffin comprising an open receptacle assembly for receiving a corpse and a cover assembly for closing the receptacle assembly, in which coffin at least one of the receptacle assembly and the cover assembly is constructed from corrugated cardboard panels fixed to a skeletal frame structure, the corrugated cardboard panels comprising a sandwich of a plurality of layers of corrugated cardboard with a foil layer disposed between adjacent corrugated cardboard layers.

2. A coffin according to claim 1, wherein the skeletal frame structure is made of wood.

3. A coffin according to claim 1, wherein the or each foil layer is an aluminium foil layer.

4. A coffin according to any one of claim 1, wherein the skeletal frame structure comprises a plurality of substantially U-shaped frames which are spaced apart along the coffin.

5. A coffin according to claim 4, wherein a floor of the receptacle assembly comprises two spaced apart floor panels fixed to a cross-member of each of the frames of the skeletal structure, each of two side walls of the receptacle assembly comprises two spaced apart side wall panels fixed to a respective arm of each of the frames, and each of two end walls of the receptacle assembly comprises a single end panel fixed to a respective endmost frame of the skeletal structure.

6. A coffin according to claim 4, wherein a top wall of the cover assembly comprises two spaced apart top wall panels fixed to a cross-member of each of the frames of the skeletal structure, each of two side walls of the cover assembly comprises two spaced apart side wall panels fixed to a respective arm of each of the frames, and each of two end walls of the cover assembly comprises a single-end panel fixed to a respective endmost frame of the skeletal structure.

7. A coffin according to any one of claim 4 wherein the arms of each of the frames diverge from the cross-member of the arm.

8. A coffin according to any preceding claim, wherein a sealing strip is fixed to the receptacle assembly and/or the cover assembly around a rim thereof.

9. A coffin according to claim 8, wherein carrying handles for the coffin are attached to the sealing strip.

10. A coffin comprising an open receptacle assembly for receiving a corpse and a cover assembly for closing the receptacle assembly, in which coffin at least one of the receptacle assembly and the cover assembly is constructed from corrugated cardboard panels fixed to a skeletal frame structure, the skeletal frame structure comprising a plurality of substantially U-shaped frames which are spaced apart along the coffin, a floor of the receptacle assembly comprising two spaced apart floor panels fixed to a cross-member of each of tire frames of the skeletal structure, each of two side walls of the receptacle assembly comprising two spaced apart side wall panels fixed to a respective arm of each of the frames, and each of two end walls of the receptacle assembly comprising a single end panel fixed to a respective endmost frame of the skeletal structure.

11. A coffin according to claim 10, wherein the skeletal frame structure is comprised of wood.

12. A coffin according to claim 10, wherein a sealing strip is fixed to the receptacle assembly and/or tire cover assembly around a rim thereof.

13. A coffin comprising an open receptacle assembly for receiving a corpse and a cover assembly for closing the receptacle assembly, in which coffin at least one of the receptacle assembly and the cover assembly is constructed from corrugated cardboard panels fixed to a skeletal frame structure, the skeletal frame structure comprising a plurality of substantially U-shaped frames which are spaced apart along the coffin, a top wall of the cover assembly comprising two spaced apart top wall panels fixed to a cross-member of each of the frames of the skeletal structure, each of two side walls of the cover assembly comprising two spaced apart side wall panels fixed to a respective arm of each of the frames, and each of two end walls of the cover assembly comprising a single end panel fixed to a respective endmost frame of the skeletal structure.

14. A coffin according to claim 13, wherein the skeletal frame structure is comprised of wood.

15. A coffin according to claim 13, wherein a sealing strip is fixed to the receptacle assembly and/or the cover assembly around a rim thereof.

* * * * *